United States Patent [19]

Batson

[11] 4,399,584

[45] Aug. 23, 1983

[54] APPARATUS FOR CLEANING FLUES

[76] Inventor: Bruce L. Batson, Straton Lake Rd., Ashland City, Tenn. 37015

[21] Appl. No.: 286,630

[22] Filed: Jul. 24, 1981

[51] Int. Cl.[3] ..... F23J 3/00

[52] U.S. Cl. ..... 15/243

[58] Field of Search ..... 15/243, 249, 242, 162, 15/163

[56] References Cited

U.S. PATENT DOCUMENTS

| | | | |
|---|---|---|---|
| 4,028,769 | 6/1977 | Coviello et al. | 15/243 X |
| 4,090,271 | 5/1978 | Piontkowski et al. | 15/243 |
| 4,138,758 | 2/1979 | Dodge | 15/243 |
| 4,185,351 | 1/1980 | Radsavitch | 15/243 |

FOREIGN PATENT DOCUMENTS

| | | | |
|---|---|---|---|
| 5876 | 6/1879 | Fed. Rep. of Germany | 15/243 |
| 95961 | 8/1922 | Switzerland | 15/243 |

*Primary Examiner*—Edward L. Roberts

*Attorney, Agent, or Firm*—Luedeka & Neely

[57] ABSTRACT

The specification discloses a flue cleaning apparatus (10) that includes a weight (12) with a beveled lower circular perimeter (14). A pair of plates (16) and (18) are secured to the top of the weight (12), and a rope (26) is attached to the weight (12) for lowering the flue cleaning apparatus (10) into a flue. The plates (16) and (18) have a rectangular shape with rounded corners for engaging the interior of a flue, and plate (16) may be removed from the flue cleaning apparatus so that the apparatus (10) will fit in flues of varying diameters.

5 Claims, 4 Drawing Figures

APPARATUS FOR CLEANING FLUES

FIELD OF INVENTION

The present invention relates to an apparatus for cleaning chimney flues and particularly relates to a flue cleaning apparatus having a cylindrical weight with a beveled lower perimeter and a plurality of plates attached to the top of the weight for scrubbing the interior of a flue.

BACKGROUND OF THE INVENTION

Numerous apparatuses have been devised for cleaning soot from the interior of a flue. However, such known devices are generally cumbersome, complicated to use and expensive to manufacture. Many of the prior art flue cleaning apparatuses are not suitable for cleaning the small flues that are typically used with add-on stoves and chimneys which have become popular since the energy crisis of the 1970s.

Many of the popular flues are actually metal stovepipes ranging from four to eight inches in diameter, and in an add-on system it is often necessary to use at least one elbow, and usually two elbows, between the firebox and the upper extreme of the flue. The soot buildup in these small flues can seriously impair the drawing function of the flue, and in extreme cases the flue can actually become clogged. The soot collection problem is aggrevated when unseasoned wood is used in the firebox.

Thus, a need has arisen for a simple and inexpensive flue cleaning apparatus especially designed for use in the smaller flues generally associated with add-on stoves and fireplaces. In particular, a need has arisen for a flue cleaning apparatus that is designed to travel through elbows in the stovepipe and that is adjustable in diameter so that it may be used with flues of varying sizes.

SUMMARY OF THE INVENTION

The above described deficiencies in the prior art are cured by the present invention in which a flue cleaning apparatus desinged for being lowered into and withdrawn from a flue to remove soot therefrom. The flue cleaning apparatus includes a weight having a diameter substantially less than the diameter of the flue and having a top. At least one plate is provided having a plurality of rounded corners formed thereon, and the plate is dimensioned so that the maximum diameter of the plate is slightly less than the diameter of the flue. When the plate is inserted into the flue, spaces are formed between the flue and the plate at positions between adjacent rounded corners of the plate. The plate is attached at its center to the top of the weight, and a rope is attached to the weight at a position adjacent to the center of the plate for lowering and withdrawing the weight and plate into and from the flue. In this manner, the rounded corners of the plate are scrubbed against the interior of the flue to dislodge soot therefrom with the soot falling down the flue and around the plate through the spaces formed between adjacent rounded corners of the plate.

In the preferred embodiment, the flue plunger includes a plurality of the plates, preferrably two plates. A first plate is provided having a first maximum diameter and a second plate is disposed adjacent and parallel with the first plate and has a second maximum diameter that is greater than the first maximum diameter. A fastener, such as a threaded fastener, is provided for selectively attaching the weight to the center or centers of the first and second plates, or the first plate alone or the second plate alone.

In accordance with the preferred embodiment, the weight is cylindrical in shape with an eye bolt disposed through the center axis of the cylindrical weight. A nut is threadedly secured to the lower end of the eye bolt which is disposed in the center of the bottom of the weight. The eye of the eye bolt is disposed at the top of the cylindrical weight above the center of the plate or plates disposed on the top of the weight. Thus, the eye of the eye bolt fastens the plates to the top of the weight. The lower perimiter of the cylindrical weight is beveled so that it will facilitate gliding of the weight around elbows in the flue.

The first and second plate preferably have a rectangular shape with rounded corners and have first and second maximum diameters, respectively, between opposing rounded corners of the plate. The second maximum diameter of the second plate is greater than the first maximum diameter of the first plate. Thus, the first and second plates may be interchanged to fit varying sized flues.

BRIEF DESCRIPTION OF THE DRAWINGS

The present invention may best be understood by reference to the embodiment described in the Detailed Description when considered in conjunction with the Drawings in which.

DETAILED DESCRIPTION

Figure 1:
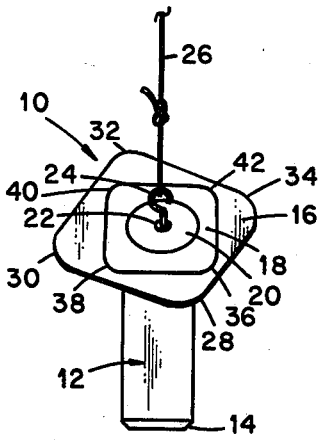
FIG. 1 is a perspective view of the flue cleaning apparatus of the present invention.

Referring now to the Drawings in which like referenced characters designate like or corresponding parts throughout the several views, there is shown in FIG. 1 a perspective view of a flue cleaning apparatus 10 embodying the present invention. The flue cleaning apparatus 10 includes a cylindrical weight 12 having a beveled lower circular perimiter 14. The beveled perimiter 14 is provided to facilitate movement of the flue cleaning apparatus 10 around and through elbows in a flue as will hereinafter be described in more detail.

In the preferred embodiment, the weight 12 is constructed of concrete and weighs approximately three pounds.

A plurality of plates, 16, 18 and 20 are attached to the top of the weight 12. Plate 16 is attached with the center of the plate 16 disposed in the center of the top of the weight 12, and the plate 18 is disposed on and above plate 16 with the center of plates 16 and 18 aligned. Plate 20 is circular in shape and is positioned on and above 18 with the center of plate 20 aligned with the centers of plates 16 and 18. An eye bolt 22 extends through the centers of plates 16, 18 and 20 and is secured in the center top of the weight 12. An eye 24 formed on the top of the eye bolt 22 engages plate 20 and secures plates 16, 18 and 20 to the top of the weight 12. A rope 26 is tied to the eye 24 and is used to suspend the flue cleaning apparatus 10 in a flue.

The plate 20 is circular in shape and functions basically as a washer to secure plates 16 and 18 to the top of the weight 12. Plates 16 and 18 are both generally rectangular in shape with rounded corners such as corners 28, 30, 32 and 34 on plate 16 and corners 36, 38, 40 and 42 on plate 18.

In the preferred embodiment, plates 16 and 18 are constructed of steel. Plate 18 has a maximum diameter between opposing corners 30 and 34, and 28 and 32, of approximately 7¾" so that it will fit relatively snugly within an 8" flue. Plate 18 has a maximum diameter of approximately 3¾" between opposing rounded corners 36 and 40, and 38 and 42, so that it will fit relatively snugly within a 4" flue. It will be understood that plates 16 and 18 could be made of different sizes to accomodate different size flues, or that more than two plates can be mounted on the top of weight 12 so that the flue cleaning apparatus 10 could be used with more than two different sized flues.

Figure 2:
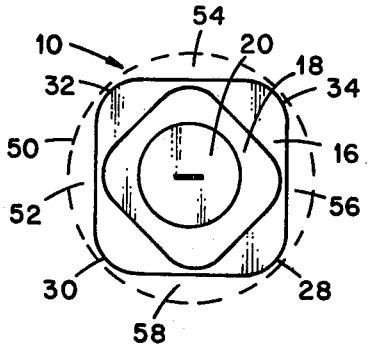
FIG. 2 is a top view of the flue cleaning apparatus with a flue shown in phantom lines.

Referring now to FIG. 2, there is shown a top view of the flue cleaning apparatus 10. A flue 50 is represented by phantom lines, and the flue cleaning apparatus 10 appears in the flue 50 as it would appear from above as it is first lowered into the flue 50. The rounded corners 28, 30, 32 and 34 of the plate 16 are disposed for scrubbing against the interior of the flue 50. A space 52 is formed between plate 16 and the flue 50 at a position between the adjacent rounded corners Likewise, spaces 54, 56, and 58 are formed between the plate 16 and the flue 50 at positions between the remaining rounded corners of the plate 16. As the plate 16 scrubs against the interior sides of the flue 50, soot is dislodged and it is allowed to fall down the flue. The soot passes or may pass around the plate 16 through the spaces 52, 54, 56 and 58.

Figure 3:
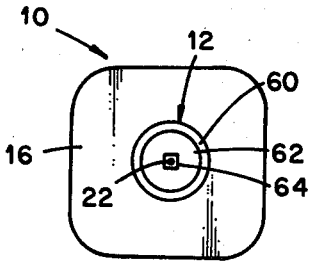
FIG. 3 is a bottom view of the flue cleaning apparatus.

A bottom view of the flue cleaning apparatus 10 is shown in FIG. 3. In this view, the bottom of plate 16 and the bottom of the weight 12 are depicted. A beveled circular perimeter 16 is formed on the bottom of the weight 12 and a recess 62 is likewise formed in the bottom of the weight 12. The eye bolt 22 extends through the center of the weight 12 and into the recess 62, and a nut 64 is threaded onto the tip of the eye bolt 22 to secure the eye bolt in the weight 12.

Figure 4:
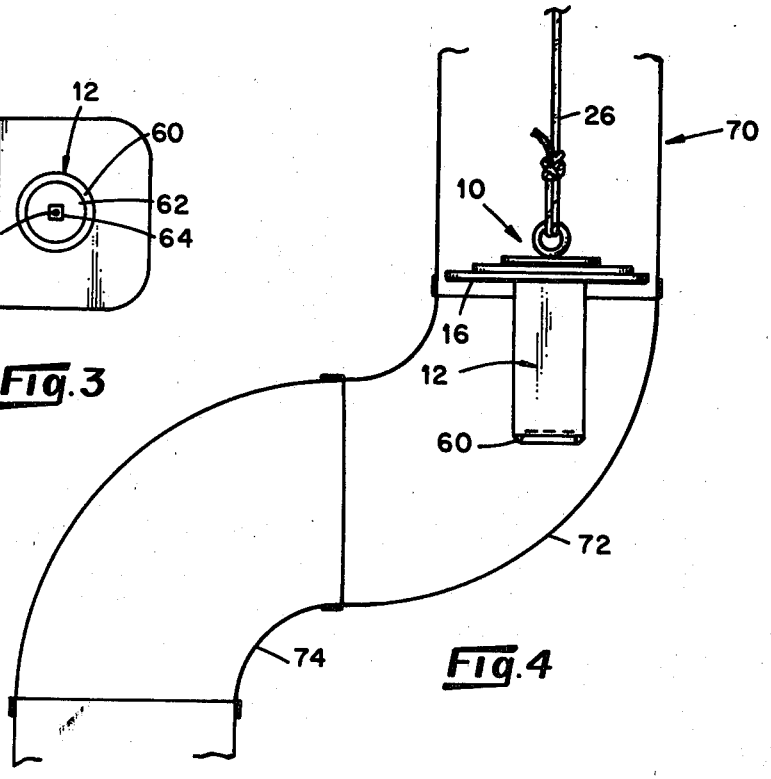
FIG. 4 is a somewhat diagramatical view of the flue cleaning apparatus shown operating in a flue.

Referring now to FIG. 4, there is shown a somewhat diagrammatical side view of the flue cleaning apparatus 10 shown operating inside a flue 70. The flue cleaning apparatus 10 is lowered down the flue 70 using the rope 76. A pair of elbows 72 and 74 are provided in flue 70 to provide a horizontal position shift of the flue. As the weight 12 is lowered toward the elbow 72, the beveled edge 60 of the weight will engage elbow 72, and because of the elbow 72, the weight 12 and the flue cleaning apparatus 10 will be forced horizontally toward elbow 72 and further down the flue. The beveled edge 60 facilitates movement of the weight 12 through the elbow 72 by gliding against the interior side of the elbow. If the weight 12 presented a sharp corner to the elbow 72, the weight would tend to dig and hold in the soot on the interior of the elbow 72.

It will also be appreciated that when the beveled perimeter 60 of the weight 12 engages the elbow 72, the entire flue cleaning apparatus 10 will tilt so that the apparatus will move easily through the elbow 72 and still provide a cleaning action. By repetitively raising and lowering the flue cleaning apparatus through the flue 70, the flue 70 will be effectively cleaned of soot and debris.

Although a particular embodiment has been described in the foregoing Detailed Description, it will be understood that the invention is capable of numerous rearrangements, modifications and substitutions of parts without departing from the spirit of the invention.

I claim:

1. A flue cleaning apparatus for being lowered into and withdrawn from a flue to remove soot therefrom;

a weight having a diameter substantially less than the diameter of the flue and having a top;

a first plate having a first maximum diameter;

a second plate disposed adjacent and parallel with said first plate with facing portions of said plates in contact with each other and said second plate having a second maximum diameter greater than said first maximum diameter so that said flue cleaning apparatus may be adjusted for flues of differing diameters by removing said second plate from said weight;

said first and second plates having a plurality of rounded corners formed thereon and being dimensioned with a maximum diameter of slightly less than the diameter of the flue so that when said plate is inserted into the flue, spaces are formed between the flue and said plate at positions between adjacent rounded corners of said plate;

means for attaching the centers of said first and second plates to the top of the said weight;

a rope; and means for attaching said rope to the weight at a position adjacent the center of said plate for lowering and withdrawing said weight and plates into and from said flue to scrub the rounded corners of said first plate against the interior of said flue to dislodge soot therefrom with said dislodged soot falling down the flue and around said plate through the spaces formed between adjacent rounded corners.

2. The flue cleaning apparatus of claim 1 wherein said weight has a beveled lower perimeter to facilitate its downward motion through said flue.

3. The flue cleaning apparatus of claim 1 wherein said weight is cylindrical in shape and has a beveled lower perimeter to facilitate its downward motion through said flue.

4. The flue cleaning apparatus of claim 3 wherein said means for attaching said rope comprises an eye bolt fastened through the center of said weight, said eye bolt including an eye disposed above the top of said weight and above the center of said plate for attachment to said rope and for engaging and holding said plate on said weight.

5. A flue cleaning apparatus for being lowered into and withdrawn from a flue that includes a flue elbow to remove soot therefrom; comprising:

cylindrical weight having a diameter of substantially less than said flue, having a top and having a circular bottom with a beveled lower circular perimeter to facilitate movement of said weight through the flue elbow as said weight is lowered down the flue;

a first plate having a rectangular shape with rounded corners and having a first maximum diameter between opposing rounded corners, said first maximum diameter corresponding to a first selected flue diameter;

a second plate having a rectangular shape with rounded corners and having a second maximum diameter greater than said first maximum diameter, said second maximum diameter corresponding to a second preselected flue diameter, said second plate being disposed below and parallel with said first plate with facing portions of said plates in contact with each other;

a washer plate disposed above said first plate;

an eye bolt extending through the centers of said washer plate, said first plate and said second plate and being threadedly secured to said cylindrical weight extending through the center of said cylindrical weight, said eye bolt including an eye disposed above the center of said washer plate for engaging said washer plate to fasten said washer plate, said first plate, and said second plate to said weight;

a rope for being attached to the eye of said eye bolt for lowering and withdrawing the flue cleaning apparatus into and from the flue; and said second plate being removeable from said plate by removing the eye bolt from said cylindrical weight so that the flue cleaning apparatus may be adjusted for use in flues of varying sizes.

* * * * *